US012553447B1

(12) United States Patent
Tang

(10) Patent No.: US 12,553,447 B1
(45) Date of Patent: Feb. 17, 2026

(54) WAIST FAN

(71) Applicant: Zhi Tang, Hunan (CN)

(72) Inventor: Zhi Tang, Hunan (CN)

( * ) Notice: Subject to any disclaimer, the term of this patent is extended or adjusted under 35 U.S.C. 154(b) by 0 days.

(21) Appl. No.: 19/188,535

(22) Filed: Apr. 24, 2025

(51) Int. Cl.
*F04D 25/08* (2006.01)
*F04D 25/06* (2006.01)
*F04D 29/64* (2006.01)

(52) U.S. Cl.
CPC ..... *F04D 25/084* (2013.01); *F04D 25/0673* (2013.01); *F04D 25/0693* (2013.01); *F04D 29/646* (2013.01); *F04D 25/06* (2013.01); *F04D 25/08* (2013.01)

(58) Field of Classification Search
CPC .. F04D 25/0673; F04D 25/0693; F04D 25/08; F04D 25/084; F04D 29/646; A41D 13/0025
See application file for complete search history.

(56) References Cited

U.S. PATENT DOCUMENTS

| | | | | |
|---|---|---|---|---|
| 9,999,270 | B2 * | 6/2018 | Washingon | A42B 1/0187 |
| 12,110,908 | B1 * | 10/2024 | Karavich | F04D 27/008 |
| 12,264,689 | B1 * | 4/2025 | Zhu | F04D 29/646 |
| 2007/0050878 | A1 * | 3/2007 | Ichigaya | A41D 13/0025 2/69 |
| 2019/0166928 | A1 * | 6/2019 | Miwa | F04D 17/16 |
| 2019/0239578 | A1 * | 8/2019 | Ichigaya | F24F 1/04 |
| 2020/0332809 | A1 * | 10/2020 | Buxton | F04D 29/601 |
| 2021/0289874 | A1 * | 9/2021 | Murphy | A62B 18/045 |
| 2022/0295917 | A1 * | 9/2022 | Ichigaya | F04D 27/004 |

FOREIGN PATENT DOCUMENTS

| | | | | |
|---|---|---|---|---|
| CN | 2616084 | Y * | 5/2004 | |
| CN | 2798637 | Y * | 7/2006 | |
| CN | 203058373 | U * | 7/2013 | |
| CN | 114944679 | A * | 8/2022 | A41D 13/0053 |
| CN | 222121806 | U * | 12/2024 | F04D 25/084 |
| JP | S6430308 | U * | 2/1989 | |
| KR | 900002669 | Y1 * | 3/1990 | F04D 25/08 |
| KR | 20080029414 | A * | 4/2008 | A42B 3/286 |
| WO | WO-03103424 | A1 * | 12/2003 | A41D 1/04 |
| WO | WO-2016021528 | A1 * | 2/2016 | A41D 13/002 |

* cited by examiner

*Primary Examiner* — Alexander B Comley
(74) *Attorney, Agent, or Firm* — HOWARD M COHN and Associates, LLC

(57) ABSTRACT

A waist fan includes a main unit configured to be worn on a user's body; and a fan unit detachably arranged on the main unit. The main unit supplies power to the fan unit to enable the fan unit to perform airflow delivery. When the fan unit is detachably arranged on the main unit, the fan unit is electrically connected to the main unit directly or via a connection cable. When the fan unit is detached from the main unit, the fan unit is electrically connected to the main unit via the connection cable.

7 Claims, 14 Drawing Sheets

WAIST FAN

FIELD

The present disclosure relates to fans, and in particular, to a waist fan.

BACKGROUND

On summer days with high temperatures, indoor people can cool down using air conditioners or large fans. However, cooling and heat relief pose significant challenges for frequently outdoor workers such as traffic police officers, delivery personnel, porters, and construction workers. This has led to emergence of waist fan s. A waist fan is a portable, compact fan that can be attached to a user's body during work—such as fastened to a belt or waistband—and blows air into the user's clothing through a fan motor, thereby lowering body temperature to achieve cooling and heat relief. However, existing waist fan s have fixed fan motors, which is inconvenient for user operation.

SUMMARY

In order to solve shortcomings in existing technologies, the present disclosure is to provide a waist fan.

A waist fan provided by the present disclosure includes a main unit configured to be worn on a user's body and a fan unit detachably arranged on the main unit. The main unit supplies power to the fan unit to enable the fan unit to perform airflow delivery.

In one or more embodiments of the present disclosure, the waist fan further includes a connection cable, when the fan unit is detached from the main unit, the connection cable is configured to electrically connect the main unit and the fan unit.

In one or more embodiments of the present disclosure, the main unit is provided with an output port; the fan unit is provided with an input port; and the connection cable includes a first wiring port and a second wiring port, wherein when the fan unit is detached from the main unit, the first wiring port of the connection cable is electrically connected to the output port of the main unit, and the second wiring port is electrically connected to the input port of the fan unit.

In one or more embodiments of the present disclosure, the output port of the main unit comprises a first output port and a second output port, wherein when the fan unit is detachably mounted on the main unit, the first output port of the main unit is connected to the input port of the fan unit; when the fan unit is detached from the main unit, the first wiring port of the connection cable is electrically connected to the second output port and the second wiring port of the connection cable is electrically connected to the input port of the fan unit.

In one or more embodiments of the present disclosure, the main unit is provided with an insertion slot, the first output port of the main unit is arranged in the insertion slot, the fan unit is provided with an insertion block configured to be capable of inserted in the insertion slot; the input port of the fan unit is arranged on the insertion block, when the insertion block is inserted in the insertion slot to have the fan unit detachably mounted on the main unit, the first output port of the main unit is electrically connected to the input port of the fan unit.

In one or more embodiments of the present disclosure, when the fan unit is detachably arranged on the main unit, the output port of the main unit is electrically connected to the input port of the fan unit.

In one or more embodiments of the present disclosure, the main unit is provided with an insertion slot, the output port is arranged in the insertion slot; the fan unit is provided with an insertion block configured to be capable of being inserted in the insertion slot, the input port is arranged on the insertion block; when the insertion block is inserted in the insertion slot to have the fan unit detachably mounted on the main unit, the output port of the main unit is electrically connected to the input port of the fan unit.

In one or more embodiments of the present disclosure, a first wiring port of the connection cable is connected to the main unit and a second wiring port of the connecting cable is connected to the fan unit; when the fan unit is detached from the main unit, the second wiring port of the connection cable is configured to move along the fan unit to achieve an electrical connection between the main unit and the fan unit via the connection cable.

In one or more embodiments of the present disclosure, a circuit board is arranged in the main unit; a motor is arranged in the fan unit; wherein the first wiring port of the connection cable is connected to the circuit board, and the second wiring port of the connection cable is configured to extend out of the main unit to enter the fan unit to be connected to the motor.

In one or more embodiments of the present disclosure, the position of the fan unit where the connection cable enters is provided with an accommodating cavity; a first winding shaft is arranged in the accommodating cavity; and when the fan unit is detachably mounted on the main unit, the connection cable is capable of being disposed in the accommodating cavity and wound around the winding shaft.

In one or more embodiments of the present disclosure, the main unit is provided with an insertion slot; the fan unit is provided with an insertion block; the accommodating cavity is arranged in the insertion block, the insertion block of the fan unit is configured to be inserted in the insertion slot to achieve detachably mounting on the main unit.

In one or more embodiments of the present disclosure, wherein a first end of the connection cable is electrically connected to the main unit and a second end of the connection cable is electrically connected to the fan unit, the second end of the connection cable is a third wiring port, the fan unit is provided with an input port, when the fan unit is detached from the main unit, the third wiring port of the connecting cable is electrically connected to the input port of the fan unit.

In one or more embodiments of the present disclosure, in the main unit is provided with an output port, when the fan unit is detachably mounted on the main unit, the third wiring port of the connection cable is detached from the input port of the fan unit, and the output port of the main unit is electrically connected to the input port of the fan unit.

In one or more embodiments of the present disclosure, the main unit is provided with an insertion slot, the output port of the main unit is arranged in the insertion slot; the fan unit is provided with an insertion block, the input port of the fan unit is arranged on the insertion block; when the insertion block is inserted in the insertion slot to have the fan unit detachably mounted on the main unit, the output port of the main unit is connected to the input port of the fan unit.

In one or more embodiments of the present disclosure, the main unit is provided with a cable accommodating cavity, a second winding shaft is arranged in the cable accommodating cavity, when the fan unit is detachably mounted on the main unit, the connection cable is capable of being accommodated in the cable accommodating cavity and wound around the second winding shaft.

In one or more embodiments of the present disclosure, a circuit board is arranged in the main unit, the first end of the connection cable is configured to pass through the cable accommodating cavity to enter the main unit to be connected to the circuit board.

In one or more embodiments of the present disclosure, a main hook is arranged on an inner side of the main unit to allow the main unit to be capable of being worn on the user's body.

In one or more embodiments of the present disclosure, a sub-hook is arranged on an inner side of the fan unit to allow the fan unit to be capable of being worn on the user's body after being detached from the main unit.

In one or more embodiments of the present disclosure, a clamping piece is arranged on an outer side of the fan unit and having an opening direction opposite to that of the sub-hook.

In one or more embodiments of the present disclosure, an opening direction of the sub-hook is same with that of the main hook.

The beneficial effects of the present disclosure is: through above configurations, during use, the waist fan can be worn on the user's body, for example, can be worn on the user's belt or waistband. Furthermore, since the fan unit is detachably mounted on the main unit, the fan unit not only can be mounted on the main unit for use but also can be detached from the main unit for use, which is convenient for the user to adjust a position of the fan unit according to actual needs, thus facilitate operation and use.

BRIEF DESCRIPTION OF THE DRAWINGS

In order to more clearly illustrate technical solutions in the embodiments of the present disclosure, the accompanying drawings required in the description of the embodiments will be briefly introduced below. The accompanying drawings in the description below are only some embodiments of the present disclosure. For those of ordinary skilled in the art, other accompanying drawings can also be obtained based on these accompanying drawings without expending creative labor.

The present disclosure is further described below in conjunction with the accompanying drawings and embodiments.

DETAILED DESCRIPTION

Figure 1:
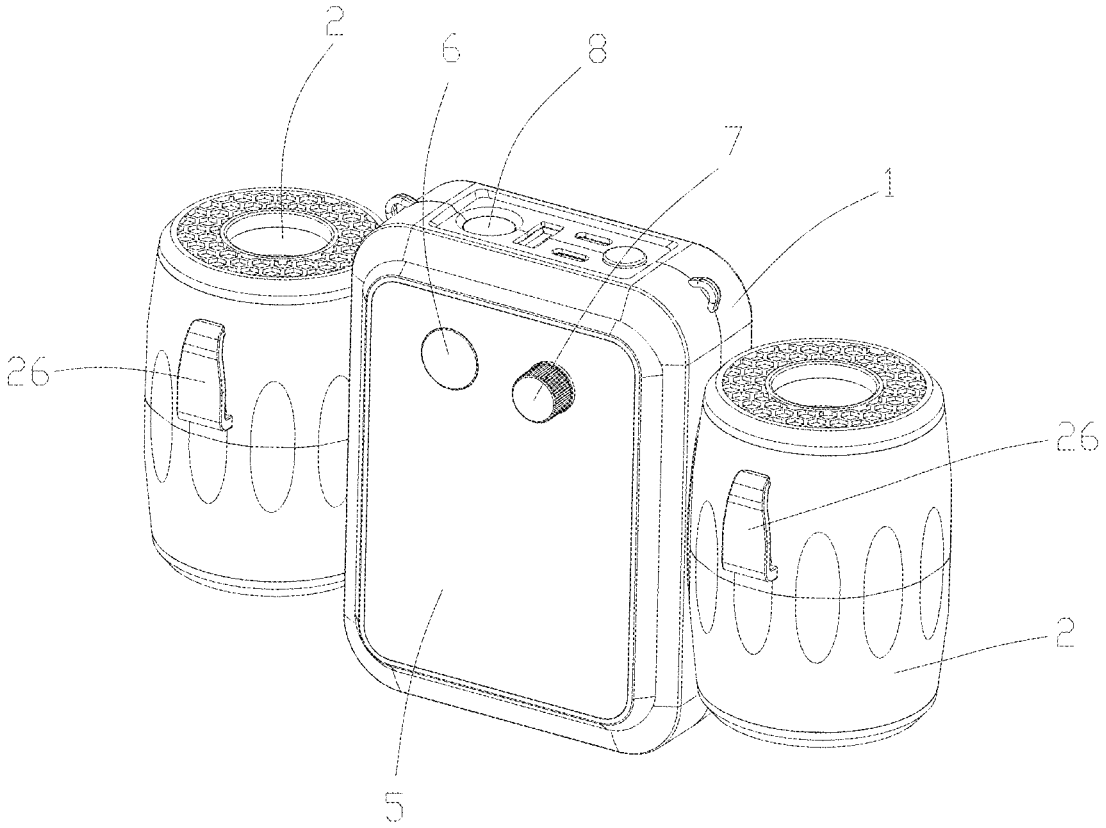
FIG. 1 is a schematic structural diagram of a waist fan according to an embodiment of the present disclosure.
Figure 2:
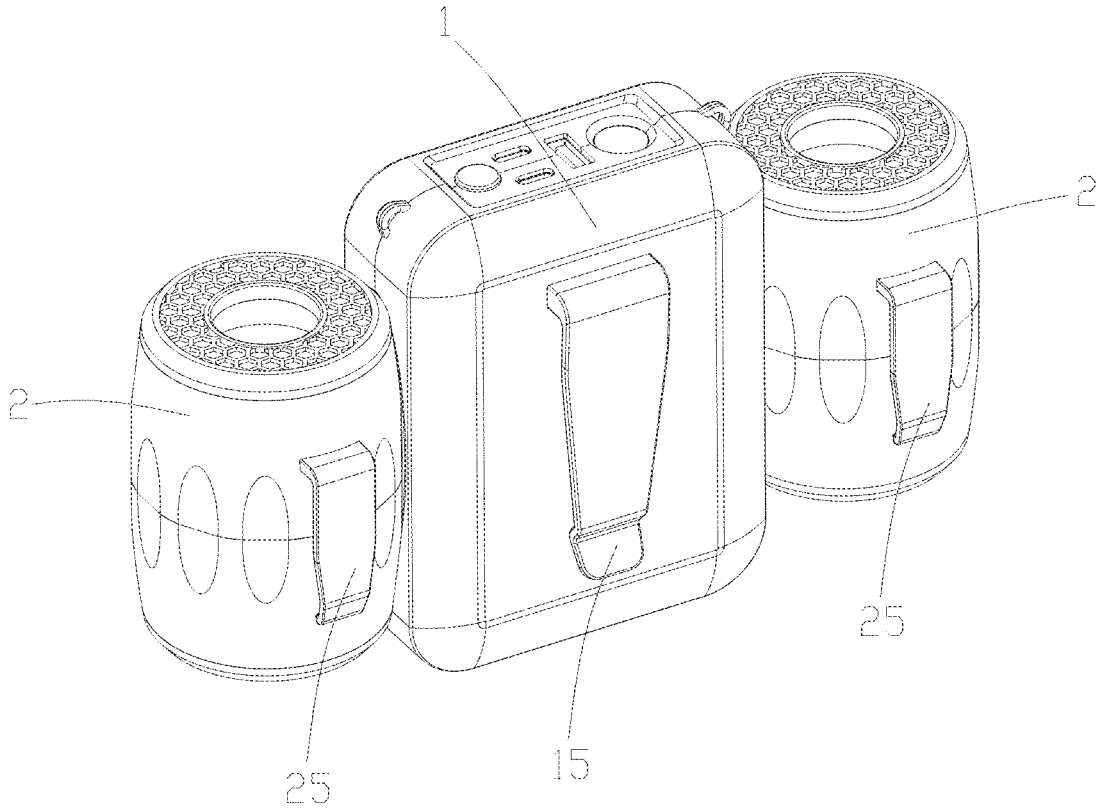
FIG. 2 is a schematic structural diagram of the waist fan from another angle.

Please referring to FIGS. 1-14, a waist-mounted by an embodiment of the present disclosure includes a main unit 1 configured to be worn on a user and at least one fan unit 2 detachably connected to the main unit 1. The main unit 1 supplies power to the fan unit 2 to enable operation. The number of the at least one fan unit 2 may be one, two, or multiple, without limitation.

Through above structural configurations, when in use, the waist fan can be worn on the user e.g., attached to a belt or waistband around the waist. Since the fan unit 2 is removably mounted on the main unit 1, the fan unit 2 can either remain attached to the main unit 1 during operation or be detached for independent use. This allows the user to adjust the fan's position according to different needs, achieving convenient usage.

The waist fan further includes a connection cable 3. When the fan unit 2 is detached from the main unit 1, the connection cable 3 electrically connects the main unit 1 and the fan unit 2. During use, the fan unit 2 can be detached from the main unit 1 while remaining powered via the connection cable 3, ensuring continuous operation. In this design, the main unit 1 remains fixed in its wearing position, while the fan unit 2 extends its operational range via the connection cable 3. For example: the main unit 1 is worn on the user's waist belt or waistband, and the fan unit 2 extends via the connection cable 3 to deliver airflow to user's abdomen, back, chest, or face.

Referring to FIGS. 3-6, as a first example of an electrical connection between the main unit 1 and the fan unit 2 by the connection cable 3: the main unit 1 includes an output port 11, the fan unit 2 includes an input port 21, and the connection cable 3 includes a first wiring port 31 and a second wiring port 32. When the fan unit 2 is detached from the main unit 1, the first wiring port 31 of the connection cable 3 is connected to the output port 11 of the main unit 1, and the second wiring port 32 of the connection cable 3 is connected to the input port 21 of the fan unit 2. In this way, the connection cable can be detached from the host and the fan. When used, the first wiring port 31 of the connection cable 3 needs to be connected to the output port 11 of the main unit 1 and the second wiring port 32 of the connection cable 3 is connected to the input port 21 of the fan unit 2, so that the main unit 1 can supply power to the fan unit 2. Furthermore, a circuit board 13 and a battery 16 are provided in the main unit 1, and the output port 11 of the main unit 1 is connected to the circuit board 13, and the battery 16 is connected to the circuit board 13. A motor 23 is provided in the fan unit 2, and the input port of the fan unit 2 is connected to the motor 23. In this way, the motor 23 can be supplied with power through the battery so that the fan unit can normally supply airflow.

Figure 3:
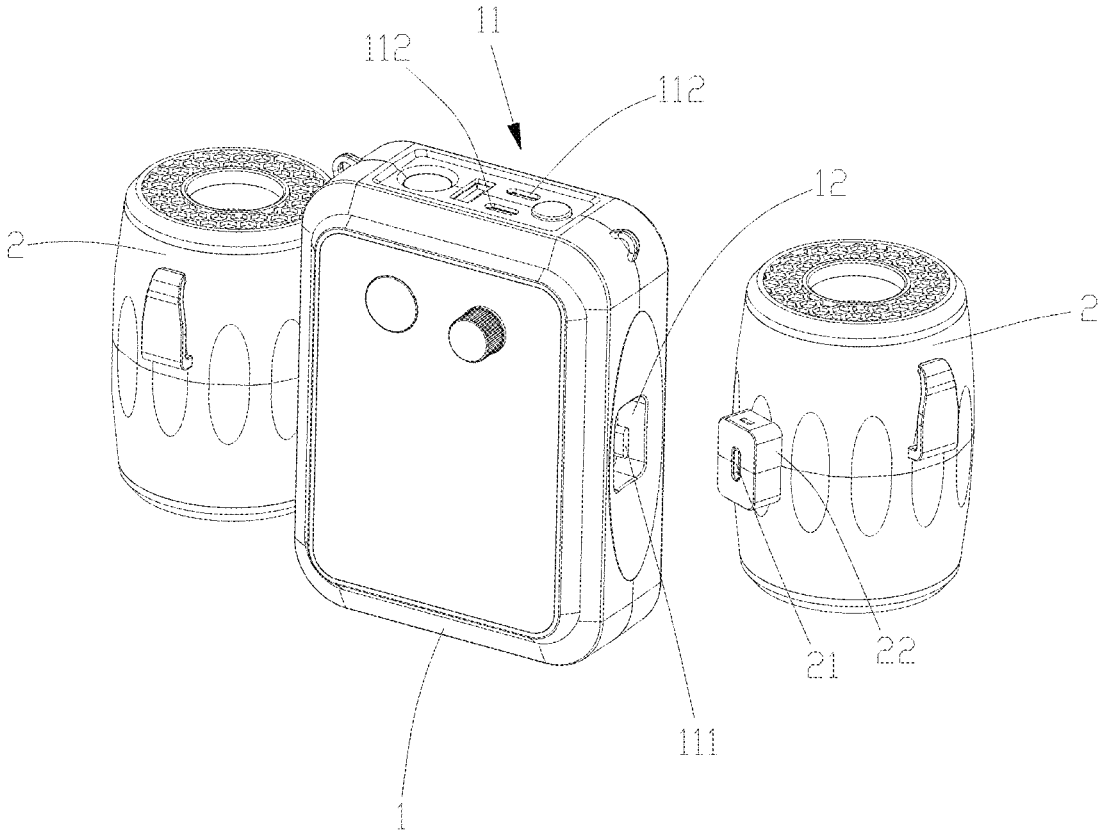
FIG. 3 is a schematic view of the waist fan with two fan units not connected to a main unit in a first embodiment of an electrical connection between the main unit and the fan unit, where the main unit includes a first output port and a second output port.
Figure 4:
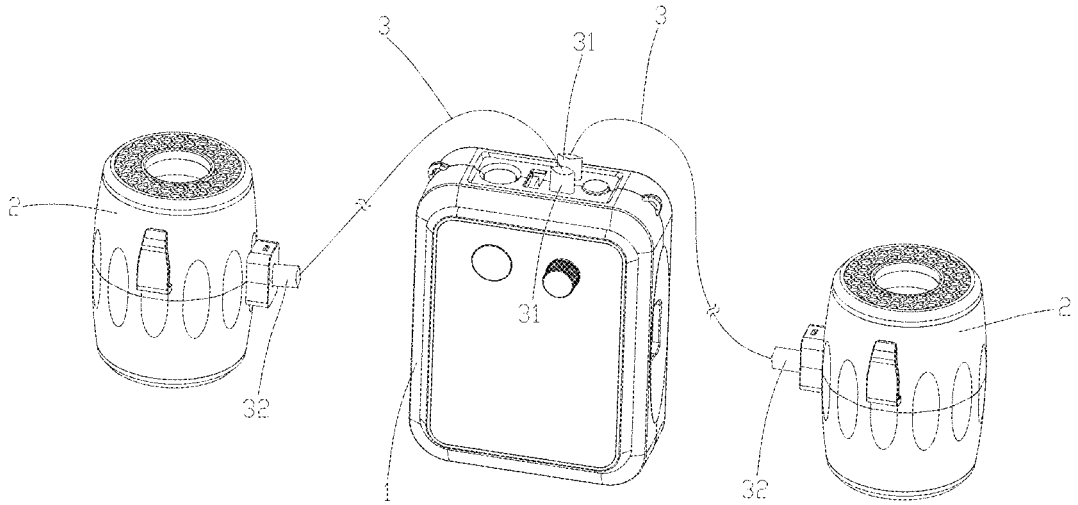
FIG. 4 is a schematic view of the waist fan of FIG. 3 with the two fan units connected to the main unit via connection cables.
Figure 5:
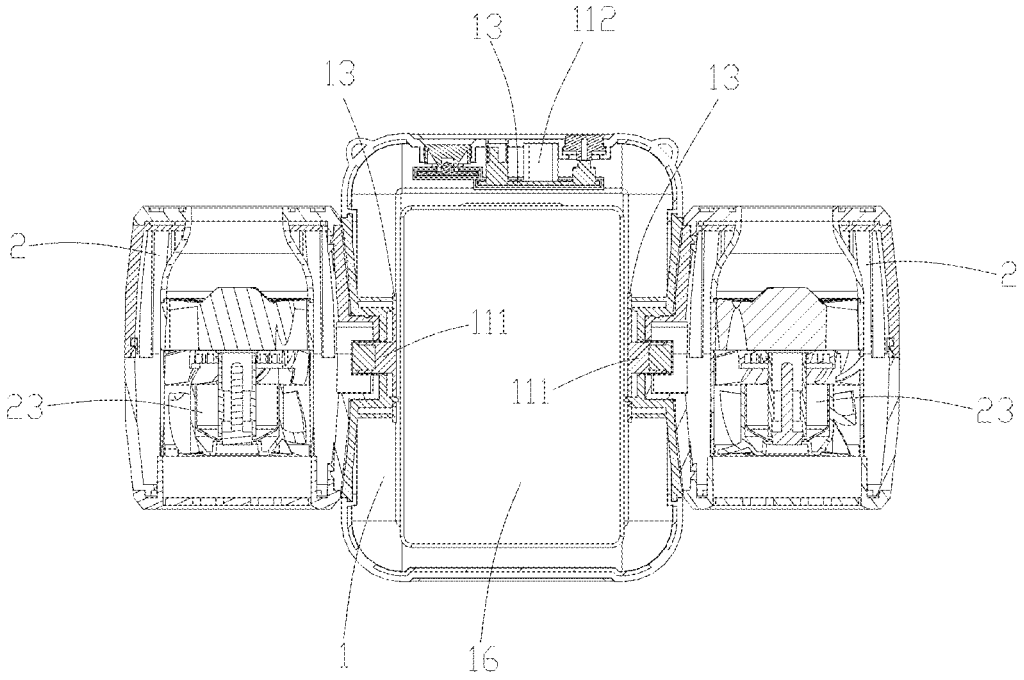
FIG. 5 is a cross-sectional view of the waist fan of FIG. 3 with the two fan units connected to the main unit.

Referring to FIGS. 3-5, the output port 11 of the main unit 1 includes a first output port 111 and a second output port 112. When the fan unit 2 is attached to the main unit 1 for use, the first output port 111 of the main unit 1 is connected to the input port 21 of the fan unit 2 so that the main unit I can supply power to the fan unit. When the fan unit 2 is used separately from the main unit 1, the first wiring port 31 of the connection cable 3 is connected to the second output port 112 of the main unit 1, and the second wiring port 32 of the connection cable 3 is connected to the input port 21 of the fan unit 2, so that the main unit 1 can supply power to the fan unit 2.

Additionally, the main unit 1 defines an insertion slot 12. The first output port 111 is arranged in the insertion slot 12. The fan unit 2 is provided with an insertion block 22. The input port 21 of the fan unit 2 is arranged on the insertion block 22. When the insertion block 22 is inserted in the insertion slot 12 to mount the fan unit 2 onto the main unit 1, the first output port 111 is connected to the input port 21 of the fan unit 2. Additionally, in at least one embodiment, an engaging piece is provided in the insertion slot 12 and configured to be engaged with the insertion block 22.

Additionally, the first output port 111 of the main unit 1 is preferably a Type-C output port, accordingly, the input port 21 of the fan unit 2 is a Type-C input port. The second output port 112 of the main unit 1 is preferably a USB output port or a Type-C output port, accordingly, the first wiring port 31 of the connection cable 3 is preferably a USB wiring port or a Type-C wiring port, and the second wiring port 32 of the connection cable 3 is preferably a Type-C wiring port. It should be understood that, the type of above ports are embodiments of the present disclosure, the above ports can be of other suitable types as long as a direct electrical connection between the main unit 1 and the fan unit 2 or an electrical connection between the main unit 1 and the fan unit 2 via the connection cable 3 is achieved. In at least one embodiment, the main unit 1 can serve as a power bank configured to supply power to other electronic devices via the second output port 112.

Figure 6:
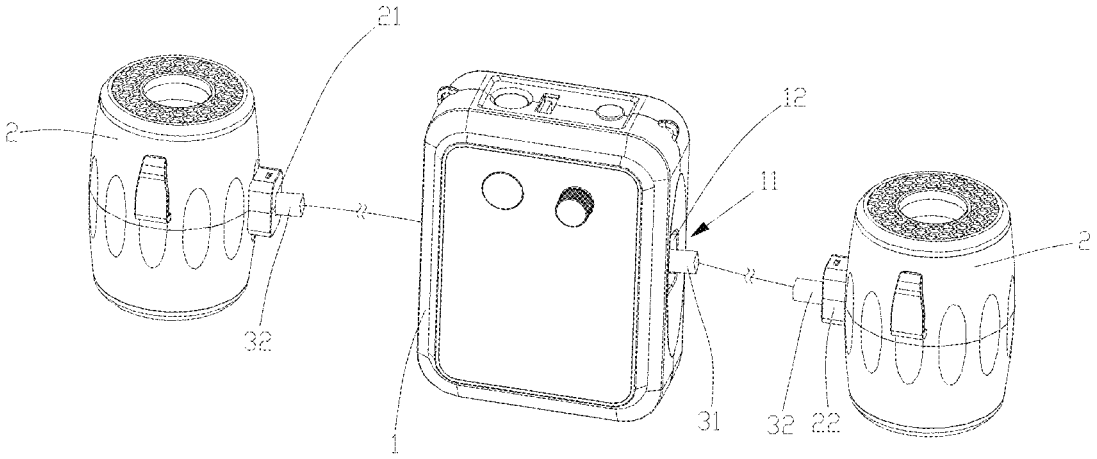
FIG. 6 illustrates the fan units are connected to the main unit via the connection cables, where the main unit includes only one output port.

Referring to FIG. 6, in the case of the main unit 1 has only one output port, when the fan unit 2 is detachably arranged on the main unit 1, that is, the fan unit 2 is attached to the main unit 1 for use, the output port 11 of the main unit 1 is connected to the input port 21 of the fan unit 2.

Additionally, the output port 11 of the main unit 1 is preferably a Type-C output port, accordingly, the input port 21 of the fan unit 2 is preferably a Type-C input port. The first wiring port 31 of the connection cable 3 is preferably a Type-C wiring port, the second wiring port 32 of the connection cable 3 is preferably a Type-C wiring port. It should be understood that, the type of above ports are embodiments of the present disclosure, the above ports can be of other suitable types as long as a direct electrical connection between the main unit 1 and the fan unit 2 or an electrical connection between the main unit 1 and the fan unit 2 via the connection cable 3 is achieved.

Additionally, the main unit 1 defines a insertion slot 12. The output port 11 is arranged in the insertion slot 12. The fan unit 2 is provided with an insertion block 22. The input port 21 of the fan unit 2 is arranged on the insertion block 22. When the insertion block 22 is inserted in the insertion slot 12 to mount the fan unit 2 onto the main unit 1, the output port 11 is connected to the input port 21 of the fan unit 2. Additionally, in at least one embodiment, an engaging piece is provided in the insertion slot 12 and configured to be engaged with the insertion block 22.

Figure 7:
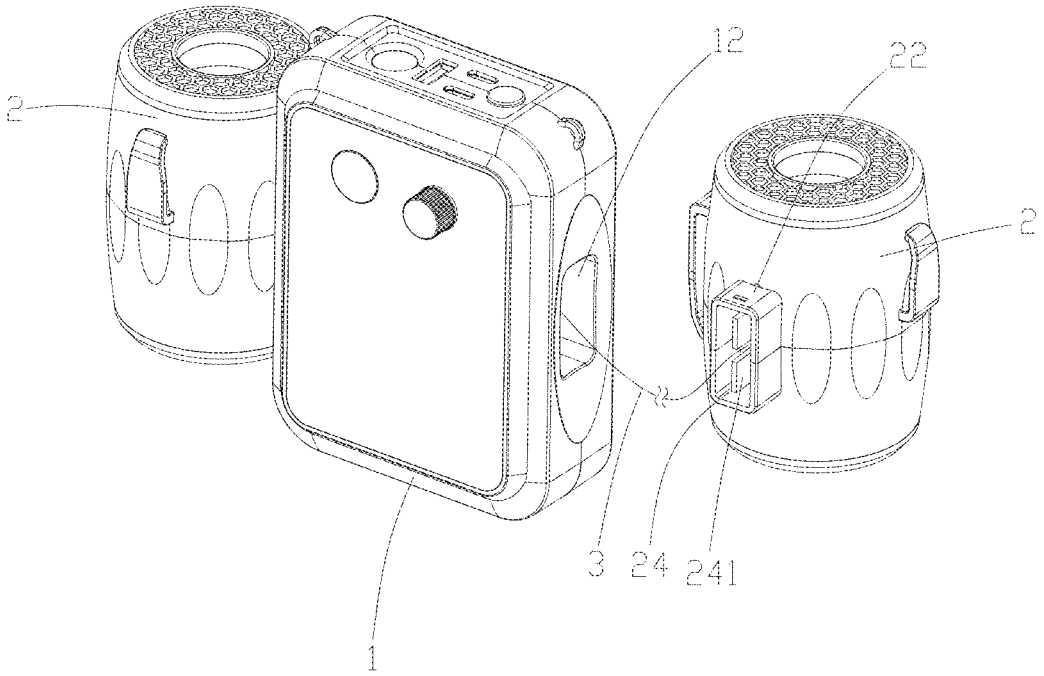
FIG. 7 is a schematic view of the waist fan with two fan units not connected to the main unit in a second embodiment of the electrical connection between the main unit and the fan units.
Figure 8:
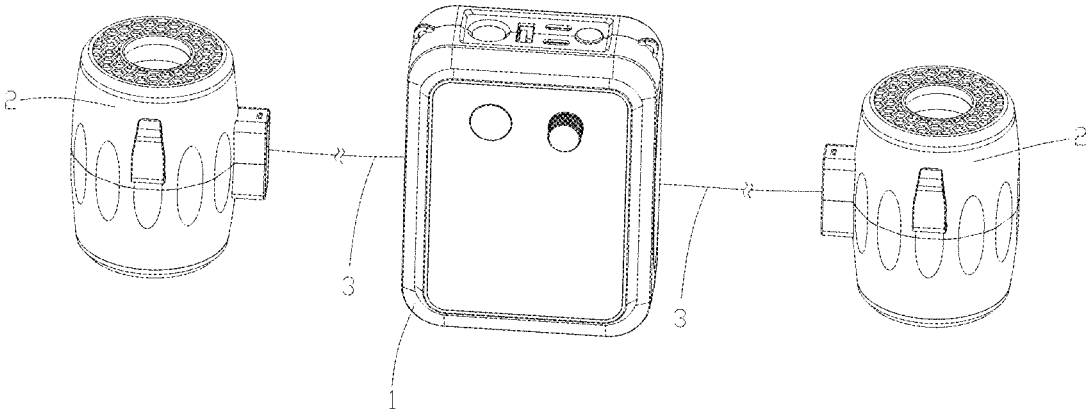
FIG. 8 is a schematic view of the waist fan of FIG. 7 with the two fan units connected to the main unit via connection cables.
Figure 9:
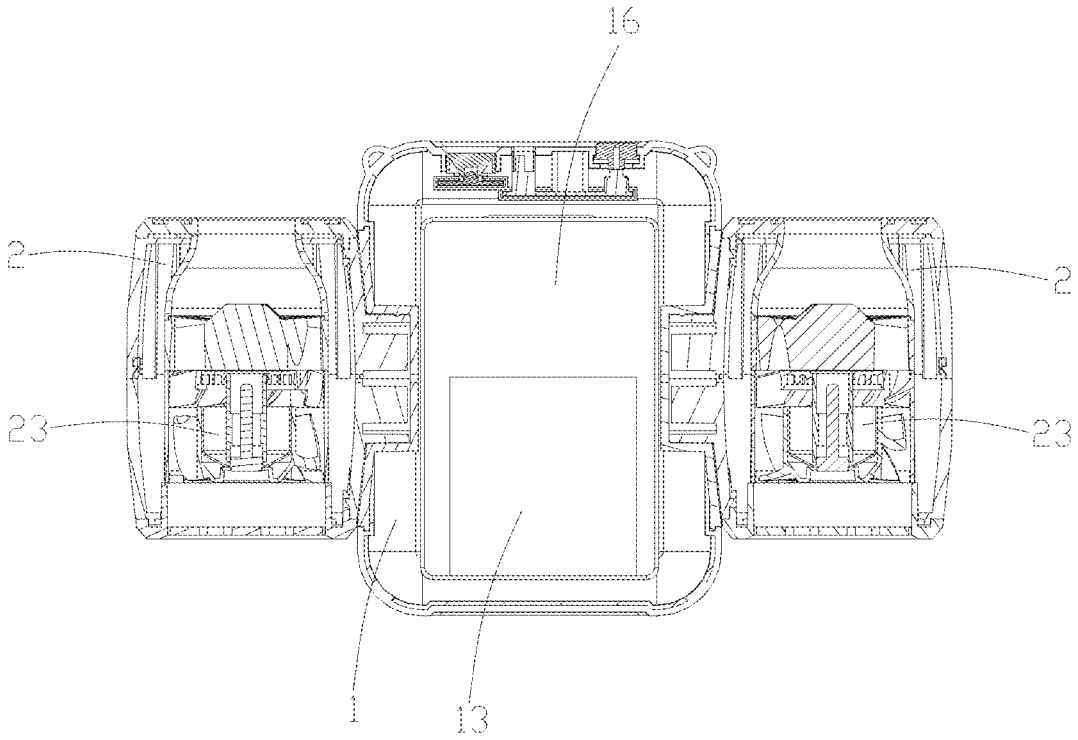
FIG. 9 is a cross-sectional view of the waist fan of FIG. 7 with the two fan units connected to the main unit.
Figure 10:
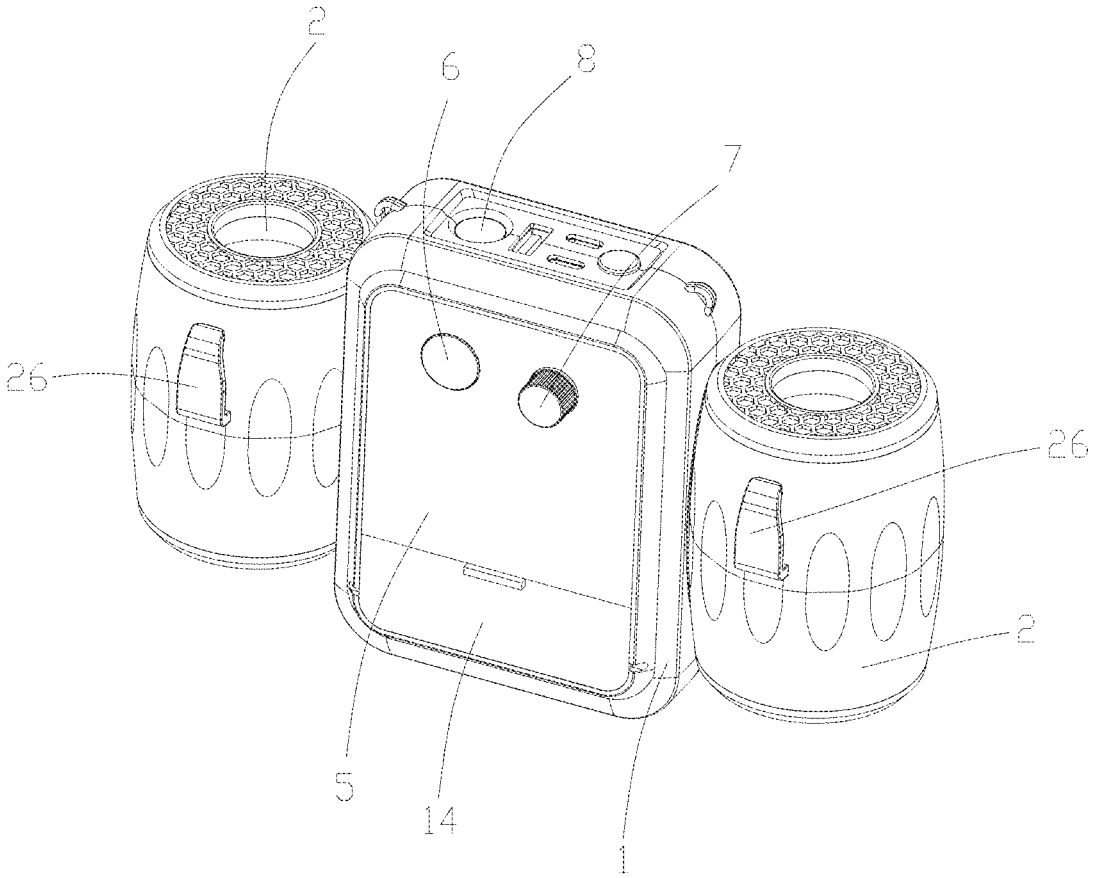
FIG. 10 is a schematic view of the waist fan with two fan units not connected to the main unit in a third embodiment of the electrical connection between the main unit and the fan units.
Figure 11:
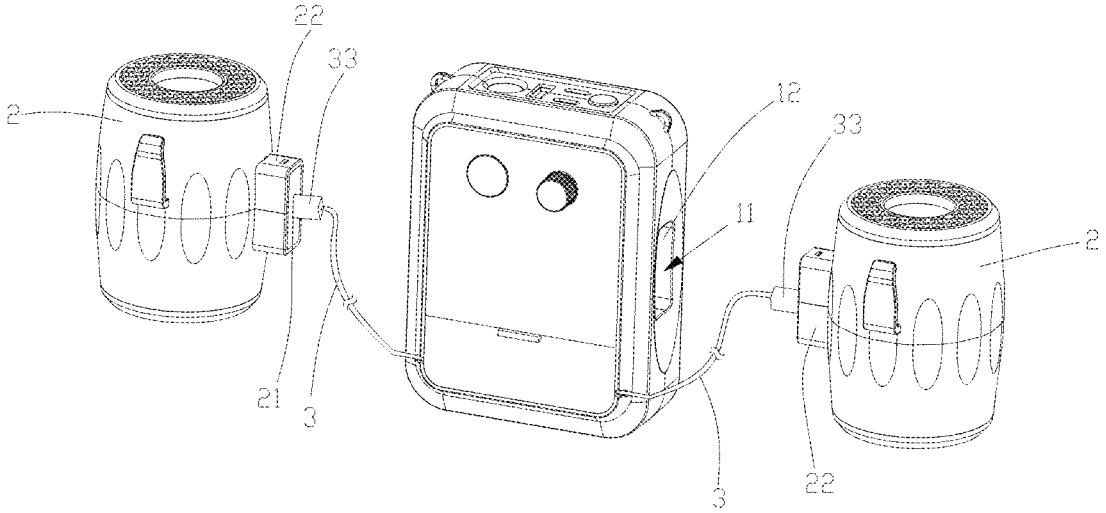
FIG. 11 is a schematic view of the waist fan of FIG. 10 with the two fan units connected to the main unit via connection cables.
Figure 12:
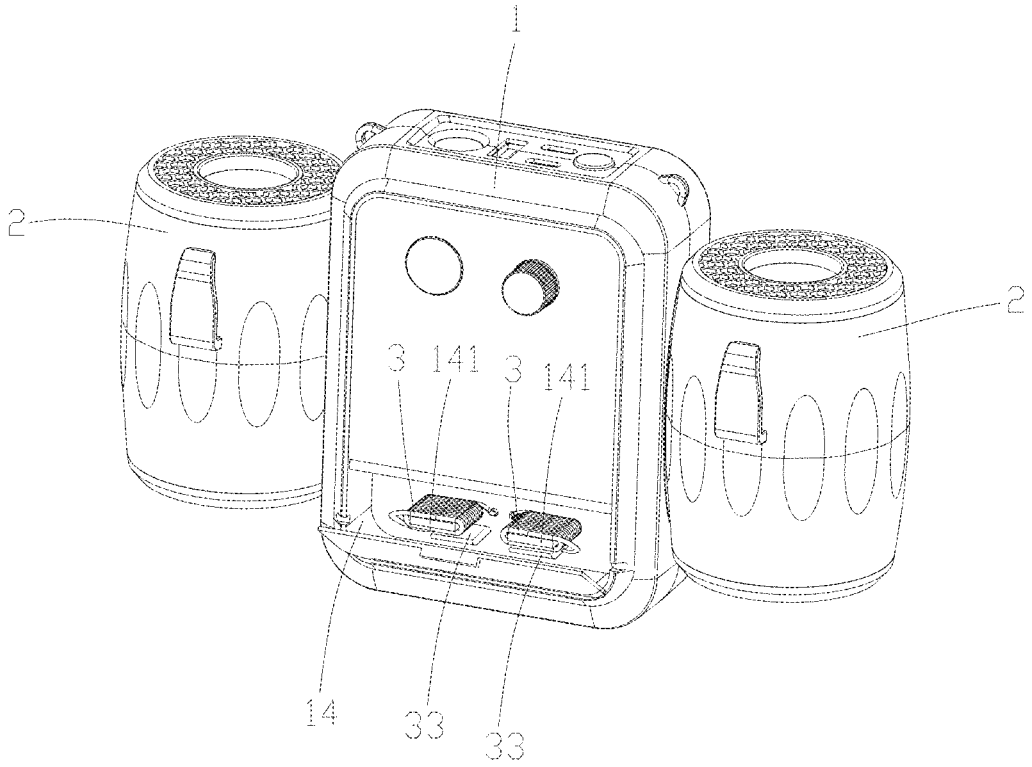
FIG. 12 is a schematic view of the waist fan of FIG. 10 with a cable accommodating cavity opened.
Figure 13:
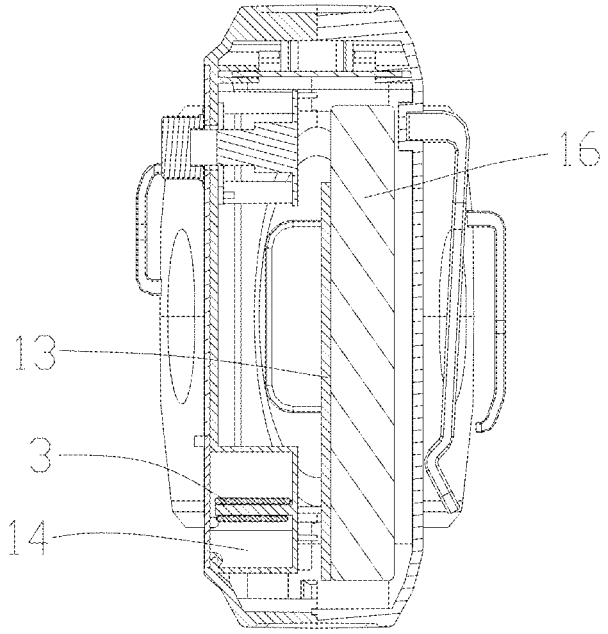
FIG. 13 is a cross-sectional view of the waist fan of FIG. 10.

Referring to FIGS. 7-9, as a second example of the electrical connection between the main unit 1 and the fan unit 2: a first end of the connection cable 3 is connected to the main unit 1, a second end of the connection cable 3 is connected to the fan unit 2, when the fan unit 2 is detached from the main unit 1, the second end of the connection cable 3 moves along with the fan unit 2 to achieve the electrical connection between the main unit 1 and the fan unit 2 via the connection cable 3. Furthermore, the main unit I can keep supplying power to the fan unit 2.

Additionally, a circuit board 13 is provided in the main unit 1, a motor 23 is provided in the fan unit 2, the first end of the connection able 3 is connected to the circuit board 13, and the second end of the connection cable 3 extends out of the main unit 1 and enters the fan unit 2 to be connected to the motor 23. Additionally, a battery 16 is mounted inside the main unit 1 and electrically connected to the circuit board 13. The battery 16 supplies power to the motor 23, enabling the fan unit 2 to operate normally for airflow delivery. Moreover, the main unit 1 may further include a charging output port, allowing the main unit 1 to function as a power bank for external devices.

Furthermore, the fan unit 2 is provided with an accommodating cavity 24 at the position where the second end of the connection cable 3 enters. A first winding shaft 241 is arranged in the accommodating cavity 24. When the fan unit 2 is removably mounted on the main unit 1, the connection cable 3 is placed into the accommodating cavity 24 and wound around the first winding shaft 241. In this design, when the connection cable does not require extension along with the fan unit 2, it can be neatly stored inside the accommodating cavity 24, ensuring a simple structure and user-friendly operation.

Additionally, the main unit 1 defines an insertion slot 12, while the fan unit 2 is provided with an insertion block 22. The accommodating cavity 24 is positioned on the insertion block 22. The fan unit 2 is removably installed onto the main unit 1 by inserting its insertion block 22 into the insertion slot 12 of the main unit 1. Moreover, the insertion slot 12 is further provided with a locking piece to securely engaged with the insertion block 22. Through cooperation between the insertion block 22 and the insertion slot 12, the connection cable 3 is effectively concealed, demonstrating a well-designed and ingenious structural solution.

Referring to FIGS. 10-13, as a third example of the electrical connection between the main unit 1 and the fan unit 2, a first end of the connection cable 3 is connected to the main unit 1, a second end of the connection cable 3 is the third wiring port 33, the fan unit 2 includes an input port 21, when the fan unit 2 is detached from the main unit 1, the third wiring port 33 of the connection cable 3 is connected to the input port 21 of the fan unit 2. In this way, the first end of the connection cable 3 is undetachable to the main unit 1, that is, the connection cable 3 can always follow the main unit 1 to prevent the connection cable 3 from being lost. The second end of the connection cable 3 is detachable from the fan unit 2 to facilitate moving of the fan unit 2.

Furthermore, the main unit 1 is equipped with an output port 11. When the fan unit 2 is removably mounted on the main unit 1 i.e., attached for integrated use, the third wiring port 33 of the connection cable 3 disengages from the input port 21 of the fan unit 2, while the output port 11 of the main unit 1 directly connects to the input port 21 of the fan unit 2 to supply power.

Preferably, the output port 11 of the main unit 1 is a Type-C port, the third wiring port 33 of the connection cable 3 is a Type-C terminal, and the input port 21 of the fan unit 2 is correspondingly a Type-C port. However, these port types are exemplary only, and alternative compatible connectors may be adopted to achieve the electrical connection between the main unit 1 and the fan unit 2.

Additionally, the main unit 1 defines an insertion slot 12 housing the output port 11, while the fan unit 2 is provided with an insertion block 22 with the input port 21 positioned thereon. When the insertion block 22 is inserted into the insertion slot 12, the fan unit 2 is removably mounted on the main unit 1, and the output port 11 of the main unit 1 and the input port 21 of the fan unit are connected to establish electrical connection. A locking piece is provided in the insertion slot 12 to better engage the insertion block 22 in the insertion slot 12.

Moreover, the main unit 1 includes a cable accommodating cavity 14 and a second winding shaft 141 is arranged in the cable accommodating cavity 14. When the fan unit 2 is detachably arranged on the main unit 1, the connection cable 3 is retracted into the cable accommodating cavity 14 and wound around the second winding shaft 141. This allows the cable to be neatly stowed when extension is unnecessary, ensuring compactness and user convenience.

Furthermore, a circuit board 13 is provided in the main unit 1. The first terminal of the connection cable 3 passes through the cable accommodating cavity 14 to be connected with the circuit board 13. The battery 16 is provided in the main unit 1 and connected to the circuit board 13, and the output port of the main unit 1 is connected to the circuit board 13. A motor 23 is provided in the fan unit 2 and connected to the input port 21 of the fan unit 2. In this configuration, when the fan unit is detachably mounted on the main unit 1 for use, the battery 16 supplies power to the motor 23 via the output port of the main unit 1. When the fan unit 2 is detached from the main unit 1 for use, the battery 16 supplies power to the motor 23 via the connection cable 3. Additionally, the main unit 1 is further provided with a charging port to enable the main unit function as a power bank.

In the present disclosure, the main unit 1 is further provided with a display screen 5, operation buttons 6, a control knob 7, and LED lights 8.

In the present disclosure, an inner side of the main unit 1 is provided with a main hook 15 for mounting the main unit 1 on the user. Specifically, it can be attached to the user's belt or waistband, or alternatively fastened to clothing, as long as secure hanging on the user's body is achieved.

Furthermore, the fan unit 2 includes a sub-hook 25 on its inner side to enable hanging on the user after being detached from the main unit 1. When being detached, the fan unit 2 can be hung on the user's body for convenient placement. Specifically, the fan unit 2 can be hang on the user's belt or waistband, or alternatively on clothing, as long as secure hanging on the user's body is achieved. In actual use, the main unit is typically worn on the side of the belt or waistband, while the sub-hook allows the fan to be hang on the belt or waistband near the user's back to deliver airflow to the back.

Figure 14:
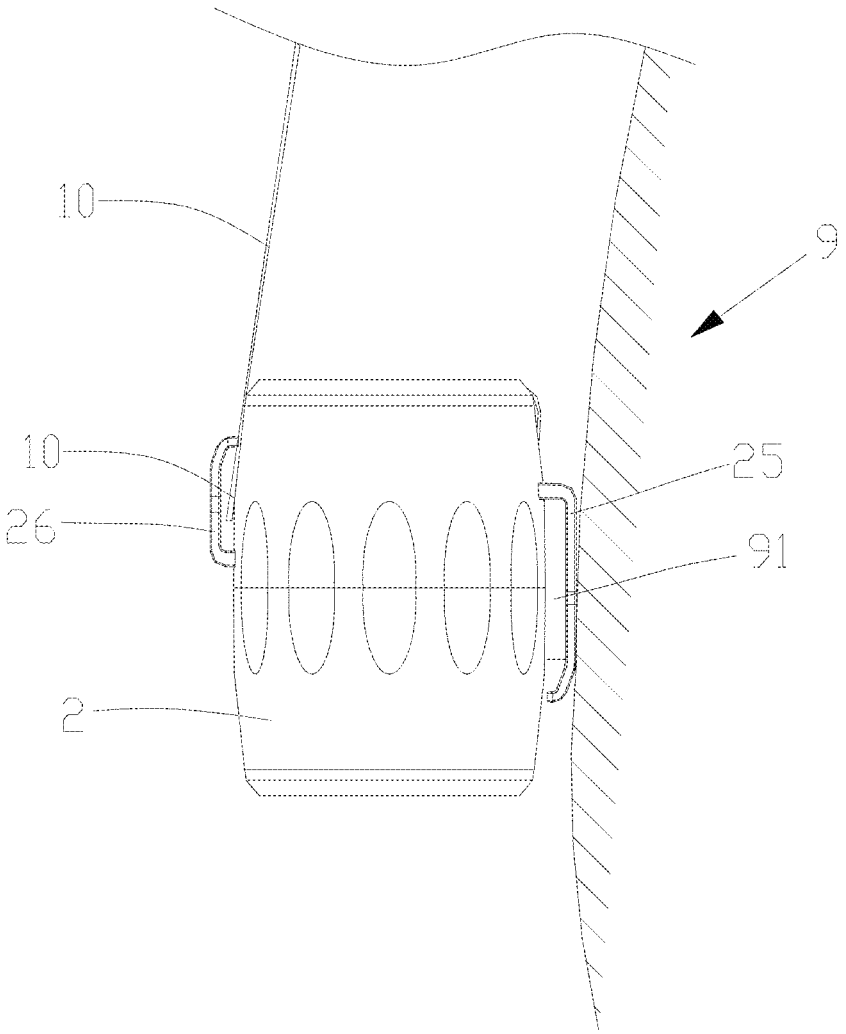
FIG. 14 illustrates the fan unit mounted between clothing and user's body via a clamping piece and a sub-hook.

Additionally, as shown in FIG. 14, the fan unit 2 is provided with a clamping piece 26 on its outer side, with an opening direction opposite to that of the sub-hook 25. During operation, the waist fan is positioned between the user's body 9 and clothing 10 to facilitate airflow delivery between layers for cooling. However, clothing may adhere to the fan unit 2 or obstruct the airflow output by the fan unit 2. To address such problem, the clamping piece 26 with the opening direction opposite to that of the sub-hook 25 is provided. During use, the sub-hook 25 is worn on the belt 91 or waistband, clothing edges can be placed into the clamping piece 26 to achieve clamping of the clothing edges, which fixes the clothing in place around the fan unit 2, thus not affecting the airflow output by the fan unit 2.

Preferably, the sub-hook 25 has a same opening direction as the main hook 15 to facilitate hanging on the user's body.

Preferably, both the main hook 15 and the sub-hook 25 are elastic, which is convenient for hanging on the user. Preferably, the clamping piece 26 is elastic, enabling easy operation and adjustment.

The above-described embodiments merely illustrate several embodiments of the present disclosure, and the description thereof is relatively specific and detailed, but it should not be construed as limiting the scope of patent protection. It should be pointed out that, for ordinary skilled in the art, several modifications and improvements can be made without departing from the concept of the present disclosure, which all fall within the scope of protection of the present disclosure. Therefore, the protection scope of the present disclosure should be determined by appended claims.

What is claimed is:

1. A waist fan, comprising a connection cable, a main unit, configured to be worn on a user's body; and a fan unit, detachably arranged on the main unit;

wherein the main unit supplies power to the fan unit to enable the fan unit to perform airflow delivery;

wherein when the fan unit is detached from the main unit, the connection cable is configured to electrically connect the main unit and the fan unit;

wherein the main unit is provided with an output port wherein the fan unit is provided with an input port;

wherein the connection cable includes a first wiring port and a second wiring port, wherein when the fan unit is detached from the main unit, the first wiring port of the connection cable is electrically connected to the output port of the main unit, and the second wiring port is electrically connected to the input port of the fan unit;

wherein the output port of the main unit comprises a first output port and a second output port, wherein when the fan unit is detachably mounted on the main unit, the first output port of the main unit is connected to the input port of the fan unit; and wherein when the fan unit is detached from the main unit, the first wiring port of the connection cable is electrically connected to the second output port and the second wiring port of the connection cable is electrically connected to the input port of the fan unit.

2. The waist fan according to claim 1, wherein the main unit is provided with an insertion slot, the first output port of the main unit is arranged in the insertion slot, the fan unit is provided with an insertion block configured to be capable of being inserted in the insertion slot; the input port of the fan unit is arranged on the insertion block, wherein when the insertion block is inserted in the insertion slot to have the fan unit detachably mounted on the main unit, the first output port of the main unit is electrically connected to the input port of the fan unit.

3. The waist fan according to claim 1, wherein a main hook is arranged on an inner side of the main unit to allow the main unit to be capable of being worn on the user's body.

4. The waist fan according to claim 3, wherein a sub-hook is arranged on an inner side of the fan unit to allow the fan unit to be capable of being worn on the user's body after being detached from the main unit.

5. The waist fan according to claim 4, wherein a clamping piece is arranged on an outer side of the fan unit and has an opening direction opposite to that of the sub-hook.

6. The waist fan according to claim 5, wherein an opening direction of the sub-hook is the same as that of the main hook.

7. A waist fan, comprising a connection cable;

a main unit, configured to be worn on a user's body; and a fan unit, detachably arranged on the main unit;

wherein the main unit supplies power to the fan unit to enable the fan unit to perform airflow delivery;

wherein when the fan unit is detached from the main unit, the connection cable is configured to electrically connect the main unit and the fan unit;

wherein the main unit is provided with an output port;

wherein the fan unit is provided with an input port;

wherein the connection cable includes a first wiring port and a second wiring port, wherein when the fan unit is detached from the main unit, the first wiring port of the connection cable is electrically connected to the output port of the main unit, and the second wiring port is electrically connected to the input port of the fan unit;

wherein when the fan unit is detachably arranged on the main unit, the output port of the main unit is electrically connected to the input port of the fan unit;

wherein the main unit is provided with an insertion slot, the output port is arranged in the insertion slot;

wherein the fan unit is provided with an insertion block configured to be capable of being inserted in the insertion slot, and the input port is arranged on the insertion block; and wherein when the insertion block is inserted in the insertion slot to have the fan unit detachably mounted on the main unit, the output port of the main unit is electrically connected to the input port of the fan unit.

* * * * *